US007346953B1

(12) United States Patent
Graves

(10) Patent No.: US 7,346,953 B1
(45) Date of Patent: Mar. 25, 2008

(54) DEVICES FOR MAINTAINING THE APPEARANCE AND INTEGRITY OF KILTIES THAT ADORN MEN'S AND WOMEN'S SHOES

(76) Inventor: Michael L. Graves, 21707 Haverstron La., Spring, TX (US) 77388

( * ) Notice: Subject to any disclaimer, the term of this patent is extended or adjusted under 35 U.S.C. 154(b) by 255 days.

(21) Appl. No.: 11/365,544

(22) Filed: Mar. 1, 2006

Related U.S. Application Data

(63) Continuation-in-part of application No. 10/775,112, filed on Feb. 11, 2004, now abandoned.

(51) Int. Cl.
*A43D 5/00* (2006.01)

(52) U.S. Cl. ..... 12/114.2; 12/114.8; 12/115.4

(58) Field of Classification Search ..... 12/114.2, 12/114.6, 114.8, 115.4, 119.5
See application file for complete search history.

(56) References Cited

U.S. PATENT DOCUMENTS 482,529 A * 9/1892 Roberts ..... 12/115.4
744,620 A * 11/1903 Roraback ..... 12/115.4
1,938,641 A * 12/1933 Rix ..... 12/115.4
2,062,758 A * 12/1936 Nicoletti ..... 12/115.4
2,983,936 A * 5/1961 Weiblen ..... 12/115.4
5,373,596 A * 12/1994 Harrell ..... 12/115.4
5,732,428 A * 3/1998 Brown ..... 12/115.4

* cited by examiner

*Primary Examiner*—Marie Patterson
(74) *Attorney, Agent, or Firm*—Mary J. Gaskin

(57) ABSTRACT

A device for restoring the appearance of a kiltie and/or tassel on a finished shoe. The device has a two-part shoe tree with a handle to which one end of a clamp is attached. The other end of the clamp is attached to a curved, cushioned shaping element, which fits over the kiltie and/or tassel. A spring-loaded tension rod mounted between the two parts of the shoe tree translates pressure to the shaping element, which applies appropriate pressure directly to the kiltie. An alternate embodiment incorporates a heating layer into the shaping element, with one or more batteries providing power to the heating layer.

15 Claims, 5 Drawing Sheets

DEVICES FOR MAINTAINING THE APPEARANCE AND INTEGRITY OF KILTIES THAT ADORN MEN'S AND WOMEN'S SHOES

CROSS REFERENCE

This application is a continuation-in-part of application Ser. No. 10/775,112, which was filed on Feb. 11, 2004, now abandoned.

FIELD OF INVENTION

This invention relates to devices for maintaining the shape, appearance, and position of kilties on men's and women's dress shoes, and specifically to devices which are designed to apply pressure to the top of the kilties during shoe storage.

BACKGROUND OF THE INVENTION

A kiltie is a long slashed tongue on a boot or shoe, which either covers the lacing or extends from beneath the lacing over the vamp or upper part of the shoe. The front end of a kiltie is generally serrated or scalloped. Often a leather tassel is attached to the kiltie for additional adornment. Sometimes the term "kiltie" is used to refer to the type of shoe having such a slashed tongue adornment. As used herein, the term "kiltie" refers to the decorative tongue and tassel, and not the whole shoe.

Kilties are generally made from leather. The problem to be solved is maintaining and/or restoring the shape of the kiltie, and, especially, preventing the front end of the kiltie from curling up and becoming unsightly, or restoring the kiltie after said curling has occurred.

In the related art, the following patents are known to the Applicant:

| Patent Number | Issue Date | Patentee |
|---|---|---|
| 5,575,016 | Nov. 19, 1996 | Bailey |
| 5,867,925 | Feb. 9, 1999 | Fattori |
| 6,055,714 | May 2, 2000 | Sproul |
| 6,470,542 (B1) | Oct. 29, 2002 | Giannini |

Bailey discloses a weight to be attached to a kiltie on a boot or shoe in order to prevent the kiltie end from curling upward due to exposure to weather or from aging. Made from a strip of malleable metal or other material, the weight attaches under the serrated edge of the kiltie and is intended to remain there; the forward edge of the weight is serrated to match the kiltie edge. Fattori discloses a shoe tassel retainer intended to be used with lace-up shoes during storage. The device serves to protect and maintain the new appearance of the shoe as it pertains to the flaps that consist of shoe lace holes and laces, and which cover the tongue of the shoe. Sproul discloses a method for "renewing" decorative leather tassels on boots and shoes after they have become unsightly from wear and tear. Giannini discloses an apparatus for protecting and maintaining decorative leather tassels during storage of boots and shoes.

The related art discussed above indicates that others have recognized the need to preserve the appearance of adornments on dress shoes. these adornments include kitties, tassels, and laces, among others. The predominant method in the related art is to provide shoe owners with the capacity to maintain or restore their shoes while they are in storage; i.e., between uses. Currently, there is no such solution offered explicitly for the maintenance/repair of shoe kitties. The invention described by Bailey (U.S. Pat. No. 5,575,016), for example, is designed to be applied while the shoe is being worn. For many people who have spent a lot of money on their shoes, it is not an option to include a restorative/maintenance device into the daily wearing of the shoes.

SUMMARY OF THE INVENTION

The present invention provides an economical and effective solution to the problem of kiltie deformation due to normal dress shoe wear and tear. The current invention is used during shoe storage. It is designed to maintain the shape of the kiltie by applying an appropriate pressure directly to the kiltie. It can also be used to restore the original shape of kitties on shoes that have not had the benefit of maintenance through use of the present invention. The present invention can be used with a dress shoe having a tassel as well as kiltie; it serves to maintain and/or restore their original appearance.

This invention provides a cushioned kiltie shaper that is connected via a hinging mechanism to a clamp, which slidably attaches to a shoe tree; it clamps down on top of the kiltie and tassel during shoe storage. The hinging action of the cushioned kiltie shaper ensures that the appropriate pressure is maintained on the kiltie to maintain and/or restore its original appearance during shoe storage.

It is an object of the present invention to provide an adjustable clamping device that is attached to a shoe tree, which is inserted into the shoe, in order to prevent curling and deformation of shoe kitties by the application of a constant, appropriate pressure onto the kiltie during storage. It is also an object of this invention to restore the original shape of shoe kilties that have been deformed due to wear.

It is another object of the present invention to provide a removable, replaceable, generally rectangular, component of the device, called the "kiltie shaper," which is shaped with a curvature conforming to the shape of the vamp portion of men's and women's shoes.

It is a further object of the present invention to provide a sliding mechanism for the clamping device that allows adjustment depending on the location of the kiltie.

A still further object of the present invention is to provide a kiltie shaper which is attached to the clamp with a "hinging" mechanism so that it can conform to the angle of the vamp of the shoe.

Yet another object of the present invention is to provide a soft cushion to the underside of the kiltie shaper in order to gently maintain or repair the original look of the shoe kiltie.

It is another object of the present invention to provide a "kiltie shaper" that holds and maintains and/or restores the original appearance of dress shoe tassels.

One more object of the present invention is to provide a kiltie shaper that warms the kiltie, tassel, and vamp of a shoe.

The specific nature of the invention, as well as other objects, uses, and advantages thereof, will clearly appear from the following description and from the accompanying drawings, the different views of which are not necessarily scale drawings.

DESCRIPTION OF THE PREFERRED EMBODIMENT

Figure 1:
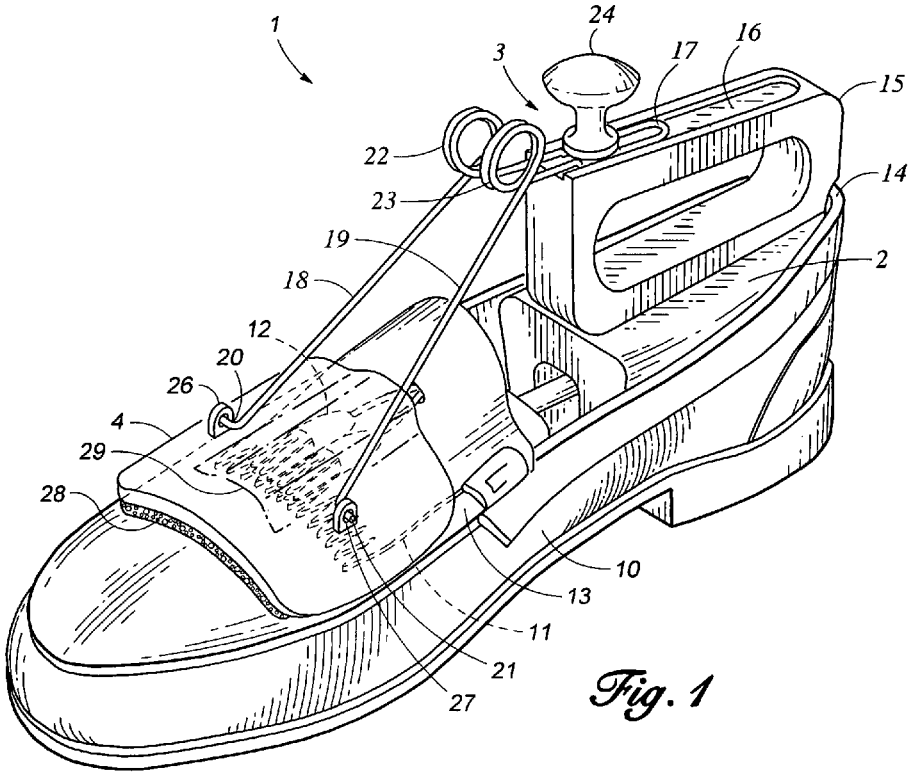
FIG. 1 is a perspective view of the present invention, shown in use in a shoe with a kiltie and tassel.

As shown in FIG. 1, the assembled device 1 has three main components: a shoe tree 2; an adjustable clamp 3; and a hinged kiltie shaper 4. The assembled device 1 has been inserted into a leather shoe 10 with a kiltie 11 and tassel 12 adorning the vamp 13 of the shoe 10, with the back of the device 1 against the cuff 14 of the shoe 10. A conventional shoe tree is generally formed from wood, plastic or metal and is designed to stretch a shoe or preserve its shape. The shoe tree 2 that is part of the present invention has a handle 15 with a groove 16 on top. The clamp 3 is formed from a length of metal, such as brass, steel or aluminum, at least ⅛ inch in diameter, which is pre-shaped to have a mounting slide 17 with two arms 18, 19, each terminating in a hook 20, 21. Optionally, as shown in FIG. 1, the clamp 3 can also be formed with wire coils 22, 23 which act as springs to urge the arms 18, 19 downward against the vamp 13 of the shoe 10. A knob 24 with a fastening element holds the mounting slide 17 in the groove 16 on the top of the handle 15 of the shoe tree 2. The hooks 20, 21 of the clamp 3 have been inserted into eyes 26, 27 on the upper surface of the kiltie shaper 4, which allows hinging movement of the kiltie shaper 4 against the vamp 13 of the shoe 10. The arrangement also allows the user to change out different sized kiltie shapers 4 or to replace the kiltie shaper 4 if it wears out. The kiltie shaper 4 is generally rectangular in shape, with a curvature allowing it to conform to the vamp 13 of a shoe. The kiltie shaper 4 is made from a material with some "give," such as plastic, leather, or stiff fabric, so that it can be used with shoes having vamps of different widths, heights, and angles. Attached to the underside of the kiltie shaper 4 is a cushioning pad 28, made from a foam rubber, plastic or rubber material, which prevents damage to the finish of the shoe 10. Optionally, the user can apply an aqueous isopropyl alcohol formulation, such as DYO Shoe Stretch, made by Manufacturing Specialties Inc. of Hutchins, Texas, to the cushioning pad 28 to aid in removing wrinkles in the kiltie 11 and the vamp 13 of the shoe 10. When the shoe 10 has a tassel 12, the kiltie shaper 4 will be formed with a raised area 29, to accommodate the tassel without flattening it, at the same time the tassel is being reshaped.

Figure 2:
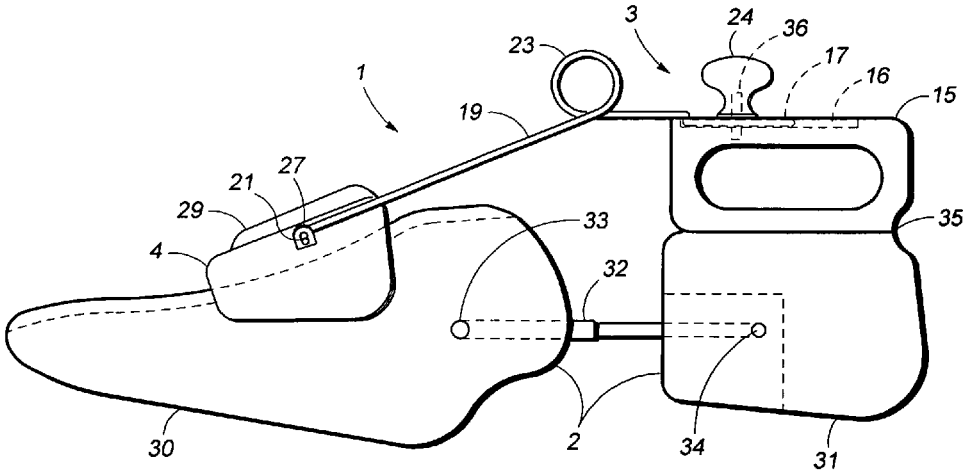
FIG. 2 is a side plan view of the present invention.
Figure 3:
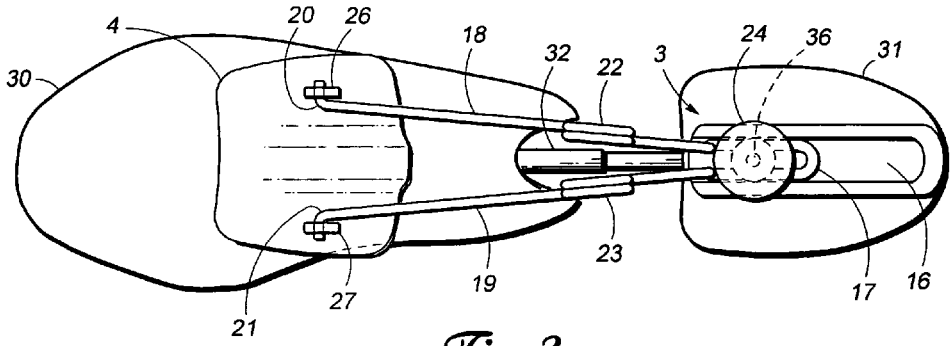
FIG. 3 is a top plan view of the present invention.
Figure 4:
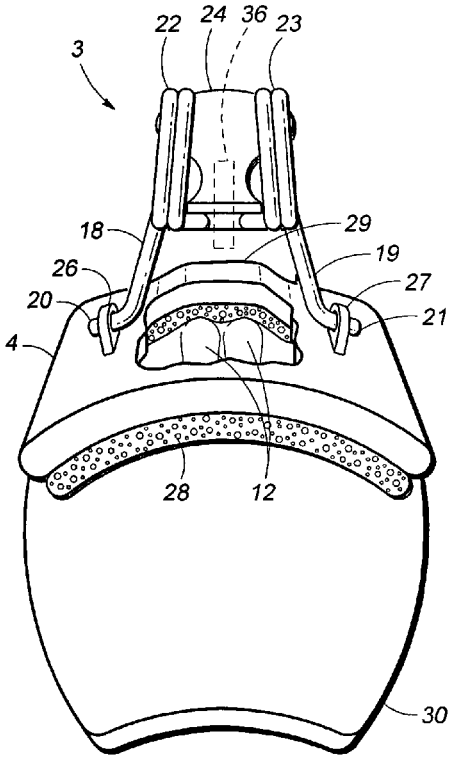
FIG. 4 is a front plan view of the present invention.

FIGS. 2, 3 and 4, show side, top, and front plan views of the present invention before use. The front portion 30 of the shoe tree 2 is attached to the heel end 31 of the shoe tree 2 with a metal spring-loaded tension rod 32, the ends of which are attached to the shoe tree 2 at pivot points 33 and 34, its movement being accommodated by slots cut into the underside of the parts of the shoe tree 2. It can be adjusted to fit shoes of differing lengths. The tension rod 32 is designed to create an appropriate amount of pressure on the kiltie shaper 4 when it breaks over center after being inserted into the shoe 10. The amount of pressure applied to the kiltie 11 is determined by the amount of tension the spring-loaded tension rod 32 is under at the precise moment that the heel end 31 of the shoe tree 2 breaks over center during insertion. The mounting slide 17 can be slid along the groove 16 in the handle 15 of the shoe tree 2, thereby moving the clamp 3 to an appropriate position, depending on the position of the shoe's kiltie 11. The knob 24 is used to screw the fastener 36 into a hole in the top of the handle 16, thereby fixing the position of the mounting slide 17 of the clamp 3 within the groove 16. The different views also show the position of the parts of the clamp 3: the arms 18, 19, extending from the mounting slide 17; the hooks 20, 21, which have been inserted into the eyes 26, 27 on the kiltie shaper 4; and the wire coils 22, 23. Finally, on the back of the heel end 31 of the shoe tree 2 is a cupped area 35, which is laid against the cuff 14 of the shoe 10 when the device 1 is being inserted into the shoe 10.

Figure 5:
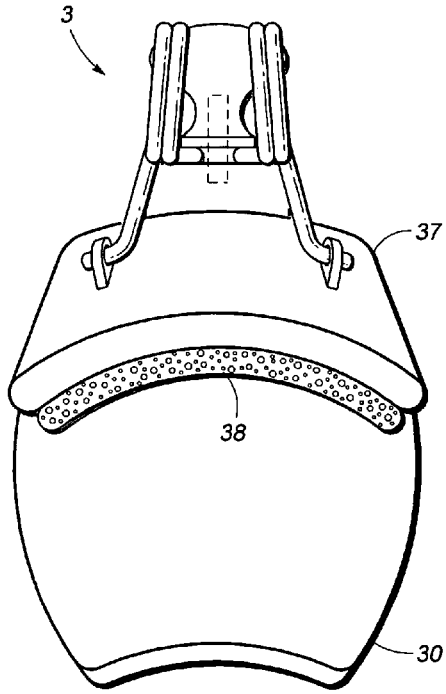
FIG. 5 is a front plan view of an alternate embodiment of the kiltie shaper of the present invention, for use with a shoe with a kiltie, but no tassel.

FIG. 5 shows the front view of an alternate version of the kiltie shaper 37, one which is used with a shoe 10 having no tassel. Unlike the kiltie shaper 4 and the cushioning pad 28 shown in FIG. 4, the cushion 38 is formed without a raised portion because no tassel needs to be accommodated.

Figure 6A:
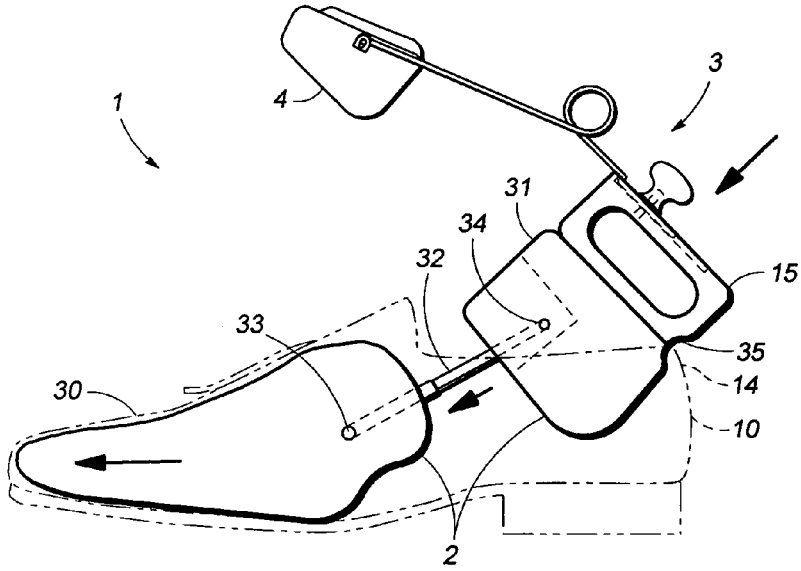
FIGS. 6A, 6B and 6C are side plan views showing the steps involved in inserting the present invention into a shoe and clamping the kiltie shaper device over the kiltie.
Figure 6B:
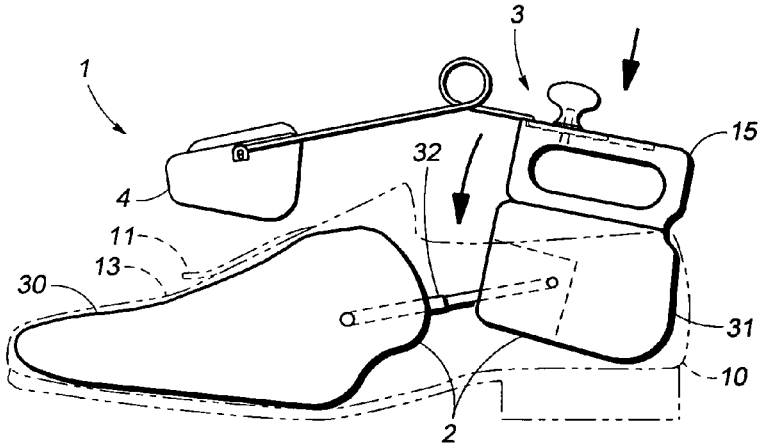
Figure 6C:
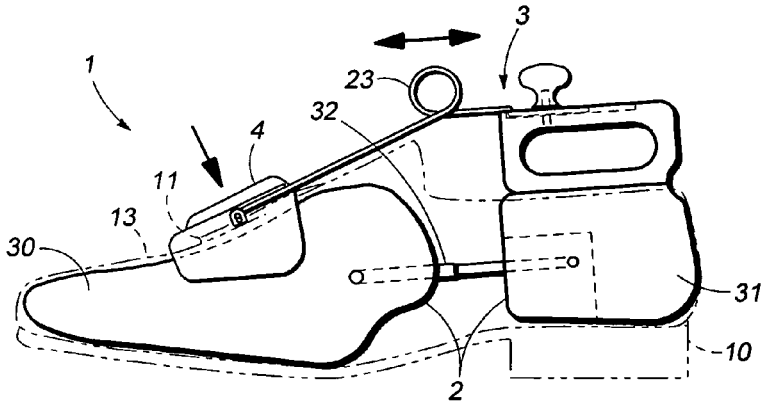

FIGS. 6A, 6B and 6C show how the assembled device 1 is used with a shoe.

As shown in FIG. 6A, after adjustment of the position of the clamp 3, the front portion 30 of the shoe tree 2 is slid firmly into the front of the shoe 10, and the cupped area 35 of the shoe tree 2 is laid against the cuff 14 of the shoe 10. (The cupped area 35 keeps the shoe tree 2 from "crawling" out of the shoe 10 as it is being inserted.) Holding the handle 15, the user begins pushing the heel end 31 of the shoe tree 2 into the heel of the shoe 10, compressing the spring-loaded tension rod 32, which has pivoted at pivot points, 33, 34.

As shown in FIG. 6B, the user continues pushing the heel end 31 of the shoe tree 2 into the heel of the shoe 10, pivoting the kiltie shaper 4 over the kiltie 11 on the vamp 13 of the shoe 10. As the heel end 31 of the shoe tree 2 "breaks" over center, the spring-loaded tension rod 32 is under tension.

In FIG. 6C, both the front portion 30 and the heel end 31 of the shoe tree 2 are locked in place in the shoe 10, and the tension in the spring-loaded tension rod 32 acts to urge the kiltie shaper 4 tightly against the kiltie 11 on the vamp 13 of the shoe 10. If the clamp 3 is formed with wire coils 23, some additional pressure may result from the spring action thereof.

In order to remove the device 1 from the shoe 10, the user holds the handle 15, pulling up on the heel end 31 of the shoe tree 2, while tilting it back. The pressure on the spring-loaded tension rod 32 is released, and the device 1 is easily removed from the shoe 10.

Figure 7:
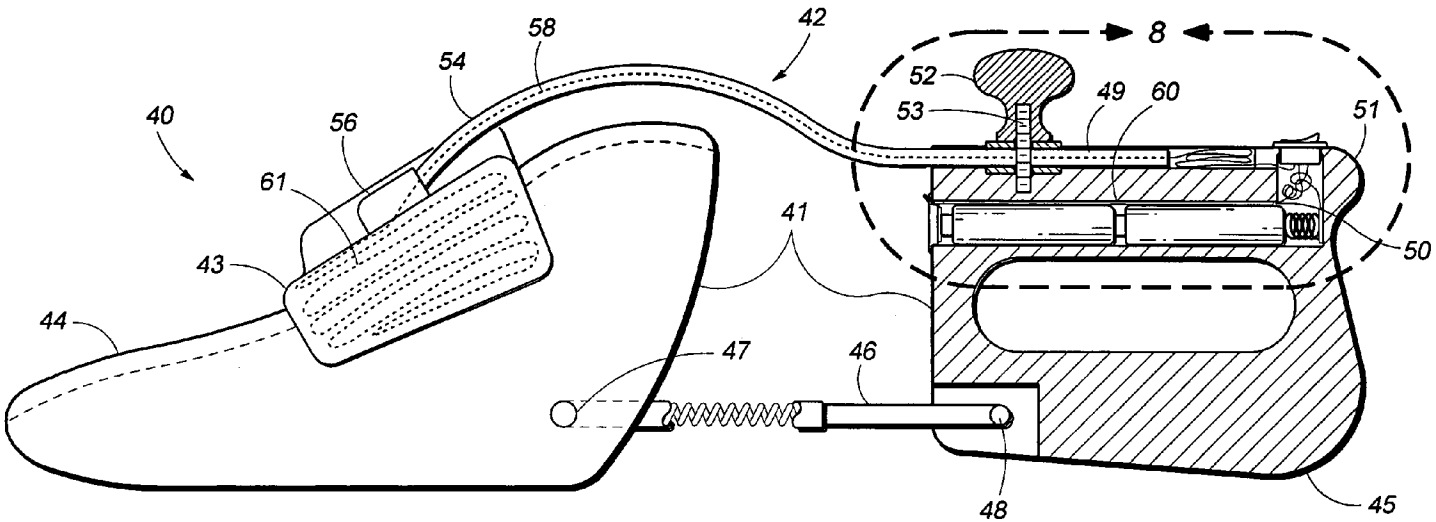
FIG. 7 is a partially sectional side plan view of an alternate embodiment of the present invention, which uses heat along with clamping pressure.

FIG. 7 shows an alternate embodiment of the present invention, one which applies warmth, along with pressure, to the kiltie 11, thereby accelerating the removal of wrinkles from the kiltie 11 and the vamp 13 of the shoe 10. Like the device 1 shown in the foregoing figures, the assembled device 40 has a shoe tree 41, a clamp 42, and a kiltie shaper 43. The front portion 44 of the shoe tree 41 is attached to the heel end 45 of the shoe tree 41 with a spring-loaded tension rod 46, the ends of which are attached to the shoe tree 41 at pivot points 47, 48, its movement being accommodated by slots cut into the underside of the parts of the shoe tree 41. The mounting slide 49 of the clamp 42 can be adjusted by sliding it along groove 50 in the handle 51 of the shoe tree 41, thereby moving the clamp 42 to an appropriate position, depending on the position of the shoe's kiltie 11. The knob 52 is used to screw the fastener 53 into a hole in the top of the handle 51, thereby fixing the position of the mounting slide 49 of the clamp 42 within the groove 50. The clamp 42 has two arms 54, (55), each formed with a curvature that presses the kiltie shaper 43 against the kiltie 11 when in use. The arms 54, (55) are attached to the top side of the kiltie shaper 43, with holders 56 (57), which permit some hinging movement of the kiltie shaper 43. The arms 54 (55), which are made of hollow metal tubing, or rigid plastic tubing, accommodate wiring 58, (59), which carries power from the battery compartment 60 in the handle 51 of the shoe tree 41 to form a service loop. The wiring 58, (59), which travels through small openings in the kiltie shaper 43, is attached to a heating layer 61, which is disposed on the underside of the kiltie shaper 43. The heating layer 61 is selected to provide warmth, without heating the leather of the shoe. It can be fabricated in a number of ways. One such embodiment is a heating element, with low amperage, disposed in a channel in a thin layer of wool, or a wool/nylon/acrylic blend. Alternatively, a heating layer of "smart wool" may be used, one which combines a conductive fiber, or thermal-bonded fiber, with wool or a wool/nylon/acrylic blend. A second layer of cushioning material may also be used, likely disposed between the heating layer 61 and the kiltie shaper 43. After the device 40 is inserted into the shoe, the heating layer 61 is activated, thereby warming the kiltie 11 and the vamp 13 of the shoe 10, enhancing the removal of wrinkles.

Figure 8:
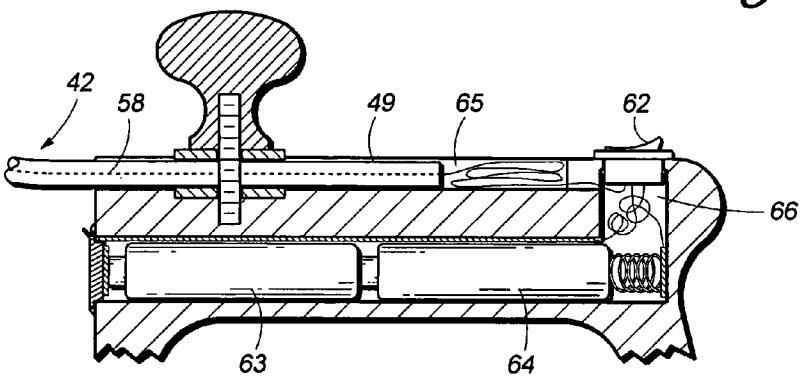
FIG. 8 is an enlarged detail drawing of the battery compartment of the alternate embodiment of the present invention.

The power to the heating layer 61 can be provided in a conventional manner, such as that shown in the detail drawing of FIG. 8. Flipping switch 62 results in the completion of a circuit. Power generated by batteries 63, 64, which can be rechargeable, activates the heating layer 61, traveling through wiring 58 (59). Extra lengths of wiring 58, (59) in cavities 65, 66 allow the mounting slide 49 of the clamp 42 to be moved without breaking the service loop.

Figure 9:
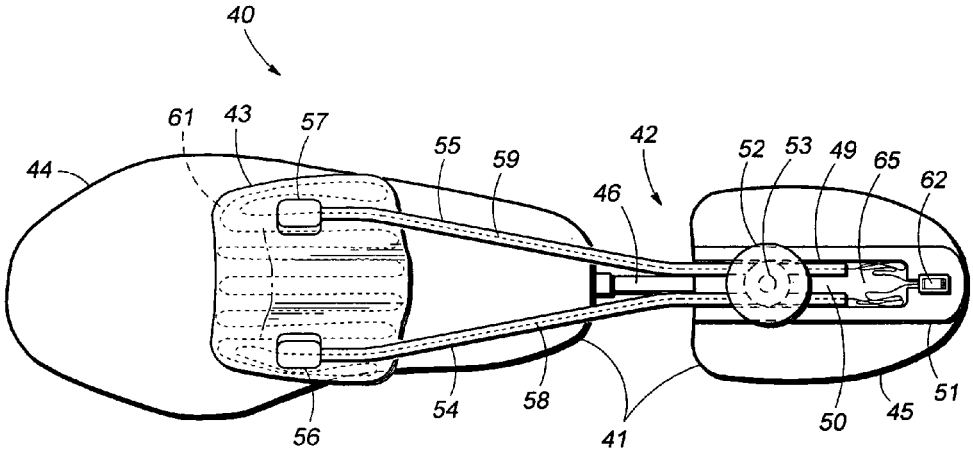
FIG. 9 is a top view of the alternate embodiment of the present invention shown in FIG. 7.

FIG. 9 shows a top plan view of the alternate embodiment of the device 40. The front portion 44 of the shoe tree 41 is attached to the heel end 45 with a spring-loaded tension rod 46. The mounting slide 49 of the clamp 42 can be adjusted by sliding it along groove 50 in the handle 51 of the shoe tree 41. The knob 52 is used to fix the position of the mounting slide 49 of the clamp 42 within the groove 50. The arms 54, 55 of the clamp 42 are attached to the top side of the kiltie shaper 43 with holders 56, 57. Wiring 58, 59 carries current to the heating layer 61, which is disposed in the kiltie shaper 43. Extra lengths of wiring are disposed in cavity 65 to permit movement of the mounting slide 49. The heating layer 61 is activated with a switch 62.

I claim:

1. A removable device for restoring a kiltie on a finished shoe to the kiltie's original appearance comprising:

a shoe tree sized to fit into the shoe, the shoe tree comprising a front portion and a heel end having a handle, the front portion being connected to the heel end with an adjustable spring-loaded tension rod;

an adjustable metal clamp having a first end for mounting onto the handle on the heel end of the shoe tree and further having a second end extending forward over the front portion of the shoe tree; and a generally rectangular curved shaping element attached to the second end of the clamp, the shaping element having a curvature for fitting over the kiltie of the shoe;

the shoe tree being instertable into the shoe, with the shaping element pressing against the kiltie, the spring-loaded tension rod having been adjusted to provide positive pressure on the shaping element after the shoe tree is inserted into the shoe.

2. The device of claim 1 wherein the shaping element has an upper surface and a lower surface, a cushion being attached to the lower surface.

3. The device of claim 1 wherein the shaping element is made from a material selected from the group consisting of plastic, leather and stiff fabric.

4. The device of claim 1 wherein the shoe further has a tassel disposed on the kiltie, and wherein the shaping element is formed to have a centered raised portion to accommodate the tassel.

5. The device of claim 1 wherein the shaping member has an upper surface with two perpendicular, spaced-apart eyes, parallel one to the other, and the second end of the metal clamp comprises two arms, each terminating in a hook for disposing through one of said eyes, thereby allowing the shaping element to partially pivot and to be removable from the clamp.

6. The device of claim 1 wherein the handle of the heel end of the shoe tree has an upper surface with a groove for accommodating the mounting end of the clamp, and the means for mounting the first end of the clamp onto the handle is a knob with a fastening element with threads for threading into a threaded hole in the upper surface of the handle.

7. The device of claim 2 wherein the cushion is absorbent, and an isopropyl alcohol solution is applied to the cushion.

8. A removable device for restoring a kiltie on a finished shoe to the kiltie's original appearance comprising:

a shoe tree sized to fit into the shoe, the shoe tree comprising a front portion and a heel end having a handle, the front portion being connected to the heel end with an adjustable spring-loaded tension rod;

an adjustable metal clamp having a first end for mounting onto the handle on the heel end of the shoe tree and further having a second end extending forward over the front portion of the shoe tree; and a generally rectangular curved shaping element attached to the second end of the clamp, the shaping element having a curvature for fitting over the kiltie of the shoe and further having a heating layer;

means for generating power;

means for conducting the power to the heating layer; and a switch;

the shoe tree being instertable into the shoe, with the shaping element pressing against the kiltie, the spring-loaded tension rod having been adjusted to provide positive pressure on the shaping element after the shoe tree is inserted into the shoe.

9. The device of claim 8 wherein the shaping element has an upper surface and a lower surface, a cushion being attached to the lower surface along with the heating layer.

10. The device of claim 8 wherein the shaping element is made from a material selected from the group consisting of plastic, leather and stiff fabric.

11. The device of claim 8 wherein the shoe further has a tassel disposed on the kiltie, and wherein the shaping element is formed to have a centered raised portion to accommodate the tassel.

12. The device of claim 8 wherein the handle of the heel end of the shoe tree has an upper surface with a groove for accommodating the mounting end of the clamp, and the means for mounting the first end of the clamp onto the handle is a knob with a fastening element which is screwed into a hole in the upper surface of the handle.

13. The device of claim 8 wherein the cushion is absorbent, and an isopropyl alcohol is applied to the cushion.

14. The device of claim 8 wherein the means for generating power is at least one battery connected to a service loop.

15. The device of claim 14 wherein the second end of the clamp comprises two hollow arms, each enclosing a length of wire, and the means for conducting the power to the heating layer comprises the wires connected to the service loop.

* * * * *